US005736200A

United States Patent [19]

Beardsley et al.

[11] Patent Number: 5,736,200

[45] Date of Patent: Apr. 7, 1998

[54] PROCESS FOR REDUCING OXYGEN CONTENT IN THERMALLY SPRAYED METAL COATINGS

[75] Inventors: M. Brad Beardsley, Laura; Gary L. Biltgen, Peoria, both of Ill.

[73] Assignee: Caterpillar Inc., Peoria, Ill.

[21] Appl. No.: 657,927

[22] Filed: May 31, 1996

[51] Int. Cl.[6] ..... C23C 4/06

[52] U.S. Cl. ..... 427/450; 427/451; 427/455; 427/456; 427/216

[58] Field of Search ..... 427/450, 451, 427/446, 216, 455, 456

[56] References Cited

U.S. PATENT DOCUMENTS

| | | | |
|---|---|---|---|
| 4,338,509 | 7/1982 | Bartuska et al. | 219/121 |
| 4,915,987 | 4/1990 | Nara et al. | 427/180 |
| 5,372,845 | 12/1994 | Rangaswamy et al. | 427/216 |

OTHER PUBLICATIONS

"Sprayforming By High–Power High–Velocity Plasma Spraying", Scholl et al., 4th National Thermal Spray Conf., Pittsburgh, May 1991.

*Primary Examiner*—Katherine A. Bareford
*Attorney, Agent, or Firm*—Pankaj M. Khosla

[57] ABSTRACT

A process for reducing oxygen content in thermally sprayed metal coatings comprises the following steps. A metal powder is provided. The metal powder has a particle size in the range of from about 10 μm to about 500 μm. Carbon is adhered and coated to the metal powder to form a carbon coated metal powder. The carbon is present in the range of from about 0.1% to about 2.0% by weight of the carbon coated metal powder. The carbon coated metal powder is thermally sprayed onto a substrate and a metal coating is deposited on the substrate. The metal coating has a lower oxygen content compared to the oxygen content of the carbon coated metal powder.

13 Claims, No Drawings

PROCESS FOR REDUCING OXYGEN CONTENT IN THERMALLY SPRAYED METAL COATINGS

TECHNICAL FIELD

The present invention relates generally to methods for reducing oxygen in metal coatings, and more particularly to a process for reducing oxygen content in metal coatings which are deposited by thermal spray techniques.

BACKGROUND ART

Thermal spray techniques are used to deposit wear resistant or thermally insulating coatings from metal and/or ceramic powders, on various components. For example, ceramic powders are thermally sprayed on the face of engine piston crowns and valves to deposit thermal barrier coatings on these components. In other instances, metal powders are thermally sprayed on various engine components to alter the thermal conductivity and/or wear characteristics of such components.

Metal coatings deposited by thermal spray techniques generally have a high oxygen content when compared to the oxygen content in the wrought metal. It is important to reduce the amount of oxygen present in the metal coating in order to improve the formability of the coating, to make the coating less brittle, and to improve corrosion resistance.

Various methods for reducing the oxygen content in thermally sprayed metal coatings are known to those skilled in the art. One such method is to thermally spray the metal powder in a chamber filled with an inert gas, such as nitrogen, for example. Another method is to use an inert gas shroud to protect the molten powder from oxidation during the thermal spray process.

One common problem encountered in the thermal spray process is the susceptibility of the sprayed metal powder to oxidation. This problem becomes more severe when one uses metal powders that have been prepared by water atomization methods. Commercially available water atomized metal powders are about half the cost of gas atomized metal powders and hence the use of gas atomized metal powders represents a waste of labor and resources. However, water atomized metal powders contain about five to ten times greater oxygen than gas atomized metal powders. Typically, water atomized metal powders contain about 10,000 ppm to about 20,000 ppm of oxygen by weight whereas gas atomized metal powders contain 100 ppm to 500 ppm oxygen by weight. Even water atomized metal powders that have been annealed contain about 1,000 ppm to 5,000 ppm oxygen by weight.

None of the heretofore mentioned thermal spray methods facilitate the lowering of oxygen content in the sprayed metal coating to ultra-low levels, such as equal to or less than 500 ppm, or 0.05% oxygen by weight. A technical article titled "Sprayforming by High-Power High-Velocity Plasma Spraying" by M. Scholl, P. Clayton, E. Elmore and J. Wooten, published in the proceedings of the Fourth National Thermal Spray Conference, Pittsburgh, Pa., U.S.A., May 4–10 1991, pages 281–288 further illustrates this problem. In that technical publication, the authors reported the problem of a six-fold increase in the oxygen content of the sprayed deposit as compared to the oxygen content in the metal wire.

A process for reducing the oxygen content in metal articles formed by powder metal pressing (PMP) is known to those skilled in the art. This process involves the addition of carbon to a metal powder prior to pressing. One drawback with this process is the requirement of an additional step of annealing. After pressing the powder metal into a desired shape, the pressed metal article must be annealed to reduce the oxides. This additional step of annealing represents a waste of time, labor and resources.

It has been desirable to have a method of depositing high quality metal coatings by thermal spray methods which result in the metal coating having a lower oxygen level as compared to the metal powder being sprayed, without requiring the additional step of annealing. It has further been desirable to have a metal mixture which can be thermally sprayable to form a metal coating having an ultra-low oxygen content without the requirement of annealing the coating. It has still further been desirable to have a thermally sprayed metal coating having low oxygen content after thermal spray deposition without requiring additional annealing. It has yet further been desirable to achieve comparably low levels of oxygen in a resultant metal coating thermally sprayed using gas or water atomized metal powders, without employing the labor intensive additional step of annealing the metal coating after thermal spray deposition.

The present invention is directed to overcome one or more problems of heretofore utilized methods for reducing oxygen content in metal coatings which are deposited by thermal spray techniques.

DISCLOSURE OF THE INVENTION

In one aspect of the present invention, a process for reducing oxygen content in thermally sprayed metal coatings is disclosed. The process comprises the following steps. A metal powder is provided. The metal powder has a particle size in the range of from about 10 μm to about 500 μm. Carbon is adhered to the metal powder and the metal powder particles are coated with carbon to form a carbon coated metal powder. The carbon is present in the range of from about 0.1% to about 2.0% by weight of the carbon coated metal powder. The carbon coated metal powder is thermally sprayed onto a substrate and a metal coating is deposited on the substrate.

In another aspect of the present invention, a carbon coated metal powder depositable by thermal spray techniques to form a metal coating is disclosed. The carbon coated metal powder has a composition, comprising, a metal powder, and carbon adhered to the metal powder. The metal powder is coated with carbon to form a carbon coated metal powder. The carbon is present in the range of from about 0.1% to about 2.0% by weight of the carbon coated metal powder mixture. The carbon coated metal powder, after being thermally sprayed on to a substrate and after being formed into a metal coating on the substrate, has an oxygen content at least 20% by weight less than the oxygen content in the carbon coated metal powder prior to being thermally sprayed.

In yet another aspect of the present invention, a thermally sprayed metal coating having reduced oxygen content is disclosed. The metal coating is deposited by a process which comprises of the following steps. A metal powder is provided. The metal powder has a particle size in the range of from about 10 μm to about 500 μm. Carbon is adhered to the metal powder and the metal powder is coated with carbon to form a carbon coated metal powder. The carbon is present in the range of from about 0.1% to about 2.0% by weight of the carbon coated metal powder. The carbon coated metal powder is thermally sprayed onto a substrate. The metal coating is deposited on the substrate. The metal coating has an oxygen content at least 20% by weight less than the oxygen content of the carbon coated metal powder.

BEST MODE FOR CARRYING OUT THE INVENTION

The term "ultra-low oxygen content", as used herein to describe the oxygen content in the metal coating, means an oxygen content equal to or less than about 0.05% oxygen by weight.

The term "reducing oxygen content", as used in the specification and the claims, means reducing the final oxygen content in the metal coating deposited by thermal spray techniques, when compared to the initial oxygen content in the carbon coated metal powder before it is sprayed onto the metal substrate. In the present invention, the oxygen content in the metal coating is reduced due to the reduction reaction of the carbon coating on the metal powder with the oxygen present in the metal powder during the thermal spraying operation, and also due to the manipulation of the plasma spray parameters, to form carbon dioxide, carbon monoxide and/or mixtures thereof, without the aid of any additional steps such as annealing, to further reduce the metal coating.

The term "providing a metal powder", as used herein means providing any metal powder, such as for example AISI 4140 steel composition. The metal powder may or may not contain oxygen. For example, because of the partial oxidation of the metal powder, the powder may have some oxygen content. The oxygen may be present in the form of elemental oxygen or in the form of a metal oxide. It must be understood that it is not essential that the metal powder selected must contain oxygen, and it is anticipated that a selected metal powders may contain only trace amounts of oxygen, or no oxygen at all. Further, the metal powder provided may be a gas atomized metal powder or a water atomized metal powder. Still further, the metal powder provided may be annealed or unannealed.

The term "gas atomized metal powders" means metal powders produced by gas atomization techniques. Such techniques are well known to those skilled in the art of producing metal powders for thermal spray applications and such powders are commercially available. In gas atomized metal powders, the oxygen content in the metal powder is usually very low, in the range of 100 ppm to 2000 ppm, or 0.01% to 0.20% by weight respectively, for example. Such metal powders are quite suitable for carrying out the present invention. However, even though the oxygen content in these gas atomized powders is initially low, these powders get oxidized during the thermal spray process and consequently result in a high oxygen content in the metal coating. The present invention addresses this problem by reducing the oxygen content in the metal coating without utilizing any further annealing of the metal coating.

The term "water atomized metal powders" means metal powders produced by water atomization techniques. Such techniques are also well known to those skilled in the art of producing metal powders for thermal spray applications and such powders are also commercially available. In unannealed water atomized metal powders, the oxygen content in the metal powder is usually quite high, in the range of 10000 ppm to 15000 ppm, or 1.0% to 1.5% by weight respectively, for example. In such instances, the present invention is particularly useful in reducing the oxygen content during the thermal spraying operation, without the aid of additional annealing of the metal coating.

The term "adhering", as used herein, means coating the metal powder with carbon powder in a manner such that the carbon powder bonds to the metal powder particles and substantially encapsulates the metal powder particles. It must be understood that the carbon powder used in this invention, which has a particle size in the range of about 0.2 μm to about 2 μm, need not fully encapsulate the metal powder particles, which typically have a particle size in the range of about 10 μm to 500 μm. However, the carbon powder must substantially bond onto the metal particle surface and must not fall off the metal powder as the powder is thermally sprayed. Various methods for adhering carbon powder onto the metal powder are known to those skilled in the art and need not be discussed here in detail.

The term "annealed", as used herein, means the annealing process for reducing oxygen in metals at high temperature and under reducing atmosphere. This process is well known to those skilled in the art, and thus will not be discussed here.

The terms "flowable", "freely flowable" and "flowability" as used herein are meant to describe a flow characteristic of a powder used for thermal spray coating applications. A flowable powder flows freely through a conduit without the aid of additional flow enhancing steps such as fluidizing, for example. However, one skilled in the art may use known fluidizing techniques to further aid in the flowability of the powder. Likewise, one skilled in the art may use known gravity flow methods to aid in the flowability of the powder.

The term "thermally spraying", as used herein means the thermal spray techniques such as, oxyacetylene torch thermal spray, gas stabilized plasma spray, water stabilized plasma spray, combustion thermal spray, and high velocity oxygen fueled spray (HVOC). It must be understood that the thermal spray techniques are not limited to the above enumerated methods and that other alternative thermal spray techniques known to those skilled in the art may be employed. For example, plasma spray methods are described in the article titled "Sprayforming by High-Power High-Velocity Plasma Spraying" by M. Scholl, P. Clayton, E. Elmore and J. Wooten, as described before and water stabilized plasma spray techniques are disclosed in U.S. Pat. No. 4,338,509 issued to Bartuska et al., both of which are incorporated herein by reference.

In the preferred embodiment of the present invention, the process for reducing oxygen content in thermally sprayed metal coatings comprises the step of providing a metal powder. The metal powder has a particle size desirably in the range of from about 10 μm to about 500 μm. Preferably, the particle size is in the range of from about 75 μm to 350 μm and even more preferably, in the range of from about 100 μm to 300 μm. A particle size less than 10 μm and greater than about 500 μm is undesirable because it detrimentally effects the adherability of the carbon particles to the metal powder.

In the preferred embodiment of the present invention, the metal coating has an oxygen content at least 20% by weight less than the oxygen content of the metal powder. It is desirable to reduce the oxygen content in the metal coating by at least 20% in order to improve the formability of the coating, to make the coating less brittle, and to improve corrosion resistance.

In the preferred embodiment, if the metal powder contains oxygen, desirably, the oxygen content is less than about 2% by weight of the metal powder. It is undesirable to provide a metal powder containing oxygen greater than about 2% because an excess amount of oxygen in the metal powder detrimentally affects the formability of the resultant coating. Preferably, the oxygen content in the metal powder is less than about 1.0% by weight of the metal powder and even more preferably, the oxygen content is less than about 0.5$ by weight. Alternatively, one may provide a metal powder containing trace amounts of oxygen. However, during thermal spray deposition, the metal particles in the flame will get oxidized. The present invention is even beneficial in reducing the oxidation which occurs during thermal spray.

In the preferred embodiment, it is desirable to provide a metal powder such that at least 85% by weight of the powder is passable through a screen having a mesh size of about 100 and at least 25% by weight of the powder is passable through a screen having a mesh size of about 325. The above ranges are desirable so that a substantial portion of the metal powder has a particle size in the range of about 50 μm to about 100 μm.

In the preferred embodiment, the metal powder is an annealed water atomized metal powder. Alternatively, one skilled in the art may use annealed or unannealed gas atomized powder, and/or annealed or unannealed water atomized metal powder. A water atomized metal powder which is annealed is desirable because it represents a savings of the resources and material costs. It is known to one skilled in the art than water atomized metal powders contain about five to ten times greater oxygen than gas atomized metal powders. The benefits of the present invention are particularly appreciable because this invention helps achieve comparably low levels of oxygen in the resultant metal coating deposited from either gas or water atomized metal powders without the additional labor intensive step of annealing the as deposited metal coating after thermal spray deposition.

In the preferred embodiment of the present invention, the process further comprises the step of adhering carbon to the metal powder and coating the metal powder particles with carbon. It is desirable and very important that the carbon particles be adhered to the metal powder, otherwise, a lowering of the oxygen content in the metal coating will not result.

In the preferred embodiment, the carbon is present in the range of from about 0.3% to about 2% by weight of the carbon coated metal powder. The term "carbon coated metal powder" as used herein means the carbon coated metal powder obtained from the step of adhering carbon to the metal powder. It is desirable that the carbon be present in an amount equal to or greater than about 0.3% by weight in order for the metal coating to have an oxygen content which is at least 20% by weight less than the oxygen content of the metal powder. It is also desirable that the carbon be present in an amount equal to or greater than about 0.4% by weight in order for the metal coating to have an oxygen content which is at least 30% by weight less than the oxygen content of the metal powder. It is undesirable to have carbon present in an amount greater than about 2% by weight because no further appreciable reduction in the oxygen content of the resultant metal coating is attained.

In the preferred embodiment, the carbon is desirably in the form of a carbon powder. It is further desirable that the carbon powder have a particle size desirably, in the range of from about 0.2 μm to about 10 μm, and preferably, in the range of from about 0.2 μm to about 2 μm. A particle size less than about 0.2 μm is undesirable because it is impractical to handle such a fine sized carbon powder. The particle size greater than about 10 μm is undesirable because it detrimentally affects the adherence and coat-ability of the carbon powder on the metal powder.

In the preferred embodiment, the carbon coated metal powder is freely flowable. It is desirable to have a free flowing metal powder because it facilitates the transportation of the metal powder to the plasma spray gun without any additional steps of fluidization or conveyance by gravity methods.

In the preferred embodiment, the carbon powder is adhered to the metal powder to form a freely flowable carbon coated metal powder by a process which comprises the step of mixing the metal powder with carbon powder and polyvinyl alcohol (PVA). The process further comprises the step of forming a paste of the metal powder, PVA and carbon powder, drying the paste and particulating the dry paste and forming a flowable carbon coated metal powder.

In the preferred embodiment of the present invention, the polyvinyl alcohol (PVA) is an aqueous solution of PVA and water. The PVA is present in the aqueous solution in an amount desirably, no greater than 20% by weight of water, even more desirably, no greater than 10% by weight of water and preferably, about 5% by weight of said water. A PVA-water solution having greater than 20% PVA is undesirable because the excess PVA would have to be ignited when the carbon coated metal powder is introduced into a plasma flame and this will detrimentally affect coating quality. Further from environmental concerns, the least amount of PVA that has to be flashed off into the atmosphere must be used. About a 5% PVA in water solution is preferred because it represents an amount of PVA suitable for most powders used for plasma spray applications, in terms of its ability to coat the surface area of such powders and make the resultant powder free flowing.

In the preferred embodiment, the carbon and metal powder mixture and the PVA-water solution are mixed in a weight ratio ranging desirably, from about 100 parts powder to 1 part PVA-water, to about 100 parts powder to 1000 parts PVA-water. Preferably, the powder and the PVA-water solution are mixed in a weight ratio ranging from about 100 parts powder to 5 parts PVA-water, to about 100 parts powder to 500 parts PVA-water. A weight ratio of powder:PVA greater than 1:0.01 is undesirable because the PVA will not be present in an amount sufficient to impart any surface modification characteristics to the powder particles or bond particles together to form micro agglomerates that are essential to make the powder flowable. A weight ratio of powder:PVA less than 1:10 is undesirable because the PVA will be present in too large a quantity and will detrimentally affect the coating during plasma spray by flashing off and igniting during deposition.

In the preferred embodiment of the present invention, the process of reducing oxygen content in metal coatings further comprises the step of thermally spraying the carbon coated metal powder onto a substrate and depositing a metal coating on the substrate. It is preferable to thermally spray by gas stabilized plasma spray method. Alternatively, one skilled in the art may also thermally spray by water stabilized plasma spray method. It should be understood that the present invention is not limited to the above two thermal spray methods but one skilled in the art may also use other thermal spray techniques such as oxyacetylene torch, combustion thermal spray, or high velocity oxygen field spray.

In the preferred embodiment, the carbon coated metal powder has a particle size in the range of from about 50 μm to about 300 μm. Desirably, the particle size is in the range of from about 100 μm to about 200 μm and preferably about 150 μm. A particle size less than about 50 μm is undesirable because the particles would be too small and would not flow too well in a plasma spray equipment, such as a conduit feeding the plasma spray powder mixture to a gun, for example. A particle size greater than about 3000 μm is not desirable because the particles would be too large and would not be suitable for injection into a plasma flame, thus detrimentally affecting coating quality.

The following Examples are provided to further illustrate the preferred embodiments of the process of the present invention. In the following Examples, the oxygen content in the metal powder and in the metal coating was measured by ASTM Method E1019-88, using a commercially available equipment having a trade name "LECO".

EXAMPLE A

A water atomized and unannealed metal powder manufactured by Hoeganaes Corporation under the trade name "Ancorsteel 1000", and having the following composition, by weight %, was provided:

| | |
|---|---|
| carbon | less than 0.01 |
| sulphur | 0.015 |
| oxygen | 1.16 |
| nitrogen | less than 0.0014 |
| phosphorous | 0.009% |
| silicon | less than 0.01 |
| manganese | 0.19 |
| copper | 0.09 |
| nickel | 0.06 |
| chromium | 0.07 |
| iron | essentially balance. |

The above crystalline metal powder had a particle size in the range of 30 μm to 500 μm and a density of about 6.75 gms/cc. About 1% by weight amorphous carbon powder having a particle size in the range of 0.5 μm to 1 μm and a density of about 2 gms/cc was adherently coated on this metal powder in the following manner.

According to one embodiment of the present invention, a mixture of 5000 gms metal powder and 50 gms carbon powder (i.e., 1% by weight) was first mixed with a 2% by weight solution of Chemcrest 77C® in water and 1 cc of Darvan C®. Chemcrest 77C® is an aqueous amine based rust inhibitor and is manufactured by Chemcrest Co., and added to inhibit corrosion of the iron. Darvan C® is polymethacrylate dispersant and is added to aid in dispersing the carbon. To this iron-carbon mixture, was added 500 gms of a 5% PVA solution in water. The mixture was mixed well to form a thick paste having a dough-like consistency. The paste was dried in an oven at 80° C. The dried paste was crushed and sieved through a 100 mesh size screen. The resultant powder was essentially a carbon coated iron powder that was freely flowable.

The above carbon coated powder was then sprayed onto a steel substrate by gas stabilized plasma spray using a METCO™ 9MB plasma gun with a 7MC nozzle and a Metco No. 2 powder injection port injecting at 12 o'clock position into the flame. The gun was energized with 28 kW, the primary gas was $N_2$ at a flow rate of 47 lpm, and the carrier gas was also $N_2$ at a flow rate of 7.3 lpm. The gun standoff distance was 125 mm. The metal coating was deposited and the oxygen content (in parts per million, (ppm) by weight) in the metal coating was determined.

The plasma spraying was done in an inert atmosphere chamber having an internal volume of about 30 cubic feet, with nitrogen gas being circulated through the chamber at a purge rate of about 10% of the chamber volume per minute.

The results are shown in Table I.

TABLE I

| | Oxygen content, ppm by weight |
|---|---|
| In metal powder | 11,600 |
| In metal coating | 5,650 |
| Wt % reduction in oxygen | 51.3% |
| Wt % carbon bonded to powder | 1.0% |

EXAMPLE B

A water atomized and annealed metal powder manufactured by Hoeganaes Corporation under the trade name "Ancorsteel 4600", and having the following composition, by weight %, was provided:

| | |
|---|---|
| carbon | 0.05 |
| sulphur | 0.015 |
| oxygen | 0.11 |
| nitrogen | less than 0.001 |
| phosphorous | 0.006 |
| silicon | 0.005 |
| manganese | 0.17 |
| copper | 0.09 |
| nickel | 1.78 |
| molybdenum | 0.54 |
| chromium | 0.03 |
| iron | essentially balance. |

The above crystalline metal powder had a particle size in the range of 10 μm to 500 μm and a density of about 6.75 gms/cc. The Sieve Analysis in Mesh (U.S. std.) of the above powder was as follows: 100 Mesh—0 wt %, 140 Mesh (105 μm to 150 μm)—9.3 wt %, 200 Mesh (74 μm to 105 μm)—38.1 wt %, 230 Mesh (62 μm to 74 μm)—26.8 wt %, 325 Mesh (44 μm to 62 μm)—24.5 wt %, and PAN (less than 36 μm)—1.3 wt %. About 0.7% by weight amorphous carbon powder having a particle size in the range of 0.5 μm to 1 μm and a density of about 2 gms/cc was mixed with this metal powder without bonding or adherently coating the carbon powder to the metal powder.

The above powder was thermally sprayed according to the process described in Example A and the oxygen content in the metal coating was determined. The results are shown in Table II.

TABLE II

| | Oxygen content, ppm by weight |
|---|---|
| In metal powder | 1,100 |
| In metal coating | 1,470 |
| Wt % reduction in oxygen | −33.6% (increase) |
| Wt % carbon mixed with powder but unbonded to powder | 0.7% |

EXAMPLE C

The same water atomized and annealed metal powder manufactured by Hoeganaes Corporation under the trade name "Ancorsteel 4600", was again provided. About 0.5% by weight amorphous carbon powder having a particle size in the range of 0.5 μm to 1 μm and a density of about 2 gms/cc was adherently coated on this metal powder by an alternate process, such as Hoeganaes Corporation's proprietary "Anchorbond™" bonding process.

The above carbon coated powder was then sprayed onto a steel substrate by gas stabilized plasma spray using a METCO™ 9MB plasma gun with a 7MC nozzle. The gun was energized with 28 kW, the primary gas was $N_2$ at a flow rate of 40 lpm, and the carrier gas was also $N_2$ at a flow rate of 7.1 lpm. The gun standoff distance was 125 mm. The above powder was thermally sprayed with a deposition efficiency of 78% and the oxygen content in the metal coating was determined. The results are shown in Table III.

TABLE III

| | Oxygen content, ppm by weight |
|---|---|
| In metal powder | 1,500 |
| In metal coating | 350 |
| Wt % reduction in oxygen | 80% |
| Wt % carbon bonded to powder | 0.5% |

INDUSTRIAL APPLICABILITY

The present invention is useful for depositing high quality metal coatings by thermal spray methods which result in the metal coating having a lower oxygen level as compared to the metal powder being sprayed, without requiring the step of annealing. The present invention is particularly useful in reducing the oxygen content in thermally sprayed metal coatings using water atomized metal powders as the starting material, by adherently coating the metal powder with carbon powder.

The benefits of the present invention are particularly appreciable considering the fact that commercially available gas atomized metal powders are about twice as expensive as water atomized metal powders and thus, the use of gas atomized metal powders represents a waste of labor and resources. However, water atomized metal powders contain about five to ten times greater oxygen than gas atomized metal powders. The present invention helps achieve comparably low levels of oxygen in the resultant metal coating deposited from gas or water atomized metal powders, without employing the labor intensive additional step of annealing the metal coating after thermal spray deposition. Hence, the present invention represents a savings of materials, labor and resources.

The thermally sprayed metal coatings deposited by the process of the present invention are used in various engine components to alter the thermal conductivity and/or the wear characteristics of such components.

Other aspects, objects and advantages of this invention can be obtained from a study of the disclosure and the appended claims.

We claim:

1. A process for reducing oxygen content in thermally sprayed metal coatings obtained from metal powders containing oxygen, comprising the steps of:

providing an oxygen containing metal powder, said metal powder having a particle size in the range of from about 10 μm to about 500 μm;

bonding carbon powder to said metal powder by mixing said metal powder with said carbon powder and polyvinyl alcohol, forming a paste of said metal powder-polyvinyl alcohol mixture, drying said paste, particulating said dry paste and forming a flowable carbon coated metal powder having a particle size in the range of from about 50 μm to about 300 μm, said metal powder being adherently encapsulated by said carbon powder, said carbon powder being present in the range of from about 0.1% to about 2.0% by weight of said carbon coated metal powder; and thermally spraying said carbon coated metal powder onto a substrate and depositing a metal coating on said substrate.

2. A process, as set forth in claim 1, wherein said metal coating has an oxygen content at least 20% by weight less than an oxygen content of said metal powder.

3. A process, as set forth in claim 1, wherein said metal coating has an oxygen content less than 0.5% by weight of said metal coating.

4. A process, as set forth in claim 3, wherein said metal coating has an oxygen content less than 0.02% by weight.

5. A process, as set forth in claim 1, wherein said metal powder has an oxygen content less than 2.0% by weight.

6. A process, as set forth in claim 1, wherein said metal powder has a particle size in the range of from about 40 μm to about 400 μm.

7. A process, as set forth in claim 1, such that at least 85% by weight of said metal powder is passable through a screen having a mesh size of about 100 and at least 25% by weight of said metal powder is passable through a screen having a mesh size of about 325.

8. A process, as set forth in claim 1, wherein said metal powder is an annealed water atomized metal powder.

9. A process, as set forth in claim 1, wherein said carbon powder has a particle size in the range of from about 0.2 μm to about 10 μm.

10. A process, as set forth in claim 9, wherein said carbon powder has a particle size in the range of from about 0.2 μm to about 2.0 μm.

11. A process, as set forth in claim 1 wherein said metal and carbon powder mixture, and said polyvinyl alcohol are mixed in a weight ratio ranging from about 1:0.01 to about 1:10, metal and carbon powder:polyvinyl alcohol respectively, and wherein said polyvinyl alcohol is present in an aqueous solution of water in an amount no greater than about 20% by weight of said water.

12. A process, as set forth in claim 1, wherein said carbon coated metal powder is thermally sprayed by a plasma spray method.

13. A process, as set forth in claim 1, wherein said carbon coated metal powder has a particle size in the range of from about 100 μm to about 200 μm.

* * * * *

UNITED STATES PATENT AND TRADEMARK OFFICE
CERTIFICATE OF CORRECTION

| | | |
|---|---|---|
| **PATENT NO.** | : | 5,736,200 |
| **DATED** | : | April 7, 1998 |
| **INVENTOR(S)** | : | M. Brad Beardsley et al. |

It is certified that error appears in the above-identified patent and that said Letters Patent is hereby corrected as shown below:

On page 1 at line 5, in a separate paragraph after the title, "PROCESS FOR REDUCING OXYGEN IN THERMALLY SPRAYED METAL COATINGS", forming a new paragraph insert, --The Government has the rights in this invention pursuant to Contract No. 70NANB4H1514 awarded by the National Institute of Standards & Technology.--.

Signed and Sealed this

Fourteenth Day of November, 2000

*Attest:*

Q. TODD DICKINSON

*Attesting Officer*

*Director of Patents and Trademarks*